US005103231A

United States Patent [19]

Niioka

[11] Patent Number: 5,103,231

[45] Date of Patent: Apr. 7, 1992

[54] ELECTROMAGNETIC WAVE ABSORBER

[75] Inventor: Yoshio Niioka, 40, Oaza-kunotsuboyama, Nishiharu-cho, Nishikasugai-gun, Aichi, Japan

[73] Assignees: Yoshio Niioka, Aichi, Japan; Marvin Gottlieb, Hiland Park, Ill.

[21] Appl. No.: 588,078

[22] Filed: Sep. 25, 1990

[30] Foreign Application Priority Data

Sep. 27, 1989 [JP] Japan ..... 1-252990

[51] Int. Cl.[5] ..... H01Q 17/00

[52] U.S. Cl. ..... 342/1; 342/4

[58] Field of Search ..... 342/1, 4

[56] References Cited

U.S. PATENT DOCUMENTS 2,985,880 5/1961 McMillan ..... 342/1
3,307,186 2/1967 Straub ..... 342/1
3,348,224 10/1967 McMillan ..... 342/1
3,440,655 4/1969 Wesch et al. ..... 342/1
3,441,933 4/1969 Tuinila et al. ..... 342/1
4,118,704 10/1978 Ishino et al. ..... 342/1

*Primary Examiner*—Mark Hellner
*Attorney, Agent, or Firm*—Koda and Androlia

[57] ABSTRACT

Disclosed is a wave absorber, comprising a wave absorbing panel prepared by forming a mixture containing a ferrite powder, a metal fiber, a molding material and a resin into a framework, by means of molding and/or press-cutting, having an arbitrary shape of hollow spaces which are adapted to the frequency and wavelength of an electromagnetic wave, and an electrically conductive filter plate, made of a mixture of a ferrite powder, a metal fiber and a resin, laminated thereon. The wave absorber may have a weathering-resistant electromagnetic wave transmitting plate on the surface thereof and the electromagnetic wave transmitting plate may comprise a reinforced ceramic panel made by laminating a ceramic plate with a Kevlar cloth, glass cloth or other web.

8 Claims, 5 Drawing Sheets

ELECTROMAGNETIC WAVE ABSORBER

BACKGROUND OF THE INVENTION

This invention relates to an electromagnetic wave absorber, hereafter to be called 'wave absorber', more particularly to a wave absorber which absorbs waves, for example, coming to the wall surface of a multi-storied building without reflecting them thereby to prevent generation of ghost on the television receiver, or which is used as the interior wall of anechoic chambers to improve wave interception efficiency.

If large-scaled constructions such as multi-storied buildings and warehouses are present in a propagation area of waves emitted, for example, from a television tower, television microwaves impinge upon the exterior wall of such buildings and reflected thereby. Accordingly, if a television wave is received near the large-scaled building, ghost is generated on the screen of the television receiver due to the time difference between the wave coming directly from the television tower and the delayed wave coming after it is reflected by the wall surface of the building, which phenomenon has given rise to an environmental problem of wave interference.

In order to cope with such ghost generation, a countermeasure is taken in some large-scaled buildings to apply a wave absorber, on the external wall surface of such buildings, which is adapted to absorb waves as much as possible without substantially reflecting them thereby. Conventional wave absorbers each consist of a ferrite tile directly bonded with an adhesive to a predetermined size of concrete plate or of a ferrite tile bonded to a concrete plate through mortar and a metal plate. Thus, if matching is achieved between the impedance of the wave absorber as viewed from the wave emitting direction and that of the free space when a television wave impinging on the wave absorber attached on the wall surface of the multi-storied building and the like, the television wave will not be reflected and the ghost phenomenon can be cleared.

In fact, however, it is extremely difficult to achieve matching between these impedance values in the conventional wave absorber, and the reflection attenuation achieved thereby is merely at the level of about 15 dB for the VHF range channels 1 to 3 and about 20 dB for the VHF range channels of 4 or more. Moreover, since the conventional wave absorber is of a multilayered structure comprising a ferrite tile, mortar, a metal plate and a concrete plate as described above, the total weight thereof will inevitably be increased, making it difficult to apply the wave absorber onto the wall surface of the building, disadvantageously. Further, it can be pointed out that the ferrite tiles constituting the wave absorber are liable to drop off due to the difference between the expansion coefficients of the respective materials, layer separation at the resin adhesive or cracking in the concrete wall to be caused by the swelling after water absorption. As a countermeasure for preventing such drop off of the tiles, it can be contemplated to reduce weight of the wave absorber. However, it is very difficult to achieve such weight reduction without lowering wave absorption characteristics and permanence thereof.

The present invention has been proposed in view of the above problems inherent in the conventional wave absorbers and for the purpose of overcoming them in a suitable manner, and it is an object of this invention to provide a wave absorber which not only has a high level of wave absorption and a relatively light weight but also can be manufactured easily.

SUMMARY OF THE INVENTION

The wave absorber according to this invention comprises a wave absorbing panel prepared by forming a mixture containing a ferrite powder, a metal fiber, a molding material and a resin into a framework having an arbitrary shape of hollow spaces (e.g. in a lattice or honeycomb structure or as circular cavities including ellipsoid) which are adapted to the frequency and wavelength of the electromagnetic wave, and an electrically conductive filter plate laminated thereon. The wave absorbing panel may have an electromagnetic wave transmitting plate having weathering resistance applied on the top surface thereof.

If a television wave, for example, of a VHF or UHF range impinges upon the thus constituted wave absorber, the impedance, as viewed from the wave emitting direction, in the wave absorber having an arrangement of lattice or honeycomb-structured, circular or other arbitrary shape of hollow spaces is relatively well matched with the impedance of the free space, whereby the wave absorber can effectively absorb the wave to assume substantially nonreflective posture. Incidentally, in the case where the electromagnetic wave transmitting plate is attached on the surface of the wave absorbing panel, weathering resistance of the exterior wall surface of the building can be improved, so that the functions as the wall material can sufficiently be imparted to the present wave absorber.

PREFERRED EMBODIMENTS OF THIS INVENTION

Next, the present wave absorber will be described by way of a preferred embodiment referring to the attached drawings. The preferred embodiment of wave absorber essentially comprises a wave absorbing panel obtained by forming a mixture containing a ferrite powder, a metal fiber, a molding material and a resin into a framework having hollow spaces adapted to the frequency and wavelength of the electromagnetic wave to be absorbed, and an electrically conductive filter plate laminated thereon.

Figure 2:
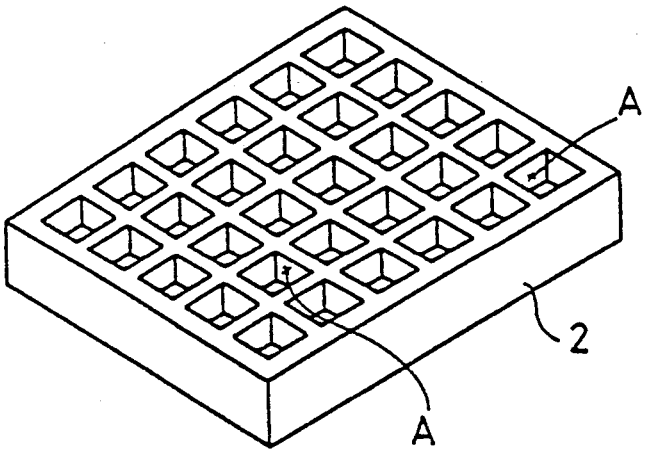
FIG. 2 shows a perspective view of a lattice-structured wave absorbing panel.
Figure 3:
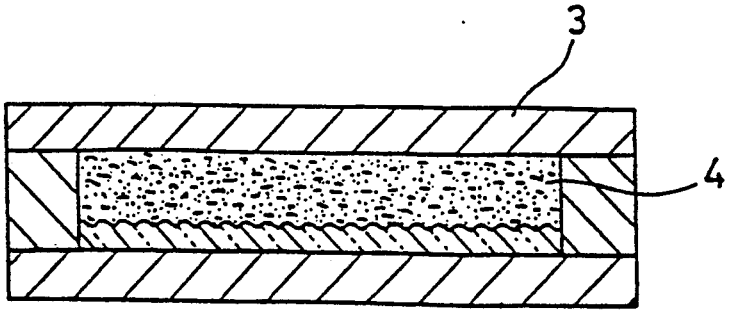
FIG. 3 illustrates molding of the lattice-structured wave absorbing panel.
Figure 4:
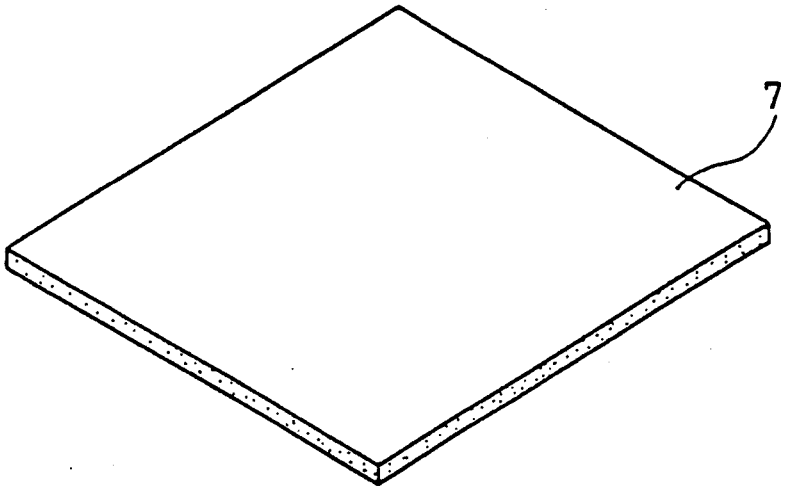
FIG. 4 shows a perspective view of a electrically conductive filter plate.
Figure 9:
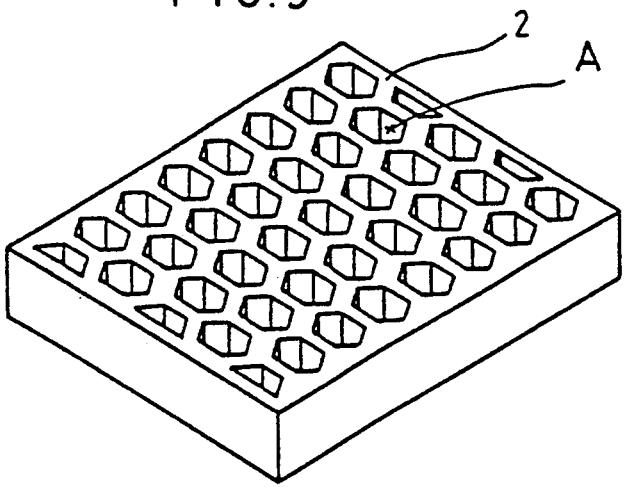
FIG. 9 shows a perspective view of a honeycomb-structured wave absorber according to another embodiment.
Figure 10:
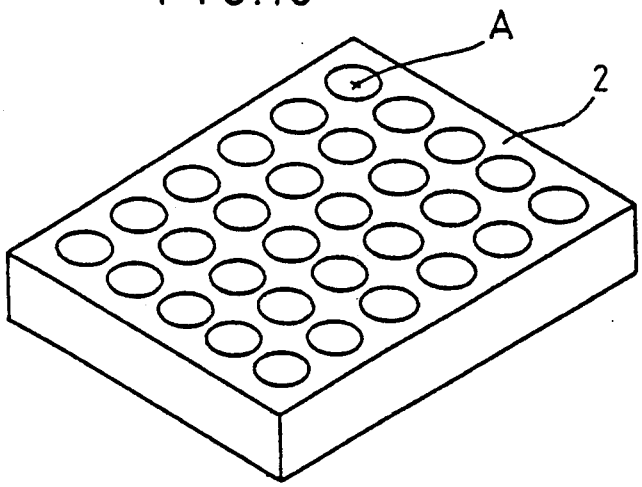
FIG. 10 shows a perspective view of a wave absorber having an arrangement of circular cavities according to another embodiment.

For example, FIG. 2 shows a lattice-structured wave absorbing panel 2 having a thickness of 8.0 mm and an area of 1.0 $m^2$, which can be formed as follows. For example, 1.2 kg of a ferrite powder ($Fe_3O_4$), 150 g of a brass fiber having a diameter of 0.5 to 0.7 mm and a length of 10 to 15 mm (as the metal fiber), 50 g of Kevlar chop having a length of 3 to 4 mm and 50 g of a glass chop or carbon graphite power (as the molding material), and 2.5 kg of a phenol resin are mixed homogeneously. After the resulting mixture is injected into a mold as shown in FIG. 3 to effect curing, the molded product is released from the mold, and thus a plate 4 having outer dimensions can be formed. For example, by press-cutting the thus obtained plate 4, a rectangular lattice-structured wave absorbing panel 2 having a multiplicity of hollow spaces A (cubic cavities in FIG. 2) having hollow spaces A with dimensions adapted to the frequency and wavelength of the waves to be absorbed can be formed. Incidentally, the shape of the hollow spaces A may be defined to form a honeycomb structure as shown in FIG. 9 or may be of arbitrary circular shape as shown in FIG. 10 so long as they have dimensions adapted to the frequency and wavelength of the waves to be absorbed. Further, while the wave absorbing panel 2 can be formed by press-cutting a blank, it can be molded in a mold in a single step. In the case of the latter molding technique, an electrically conductive filter plate 7 to be described later may be molded together with the wave absorbing plate 2.

Figure 1:
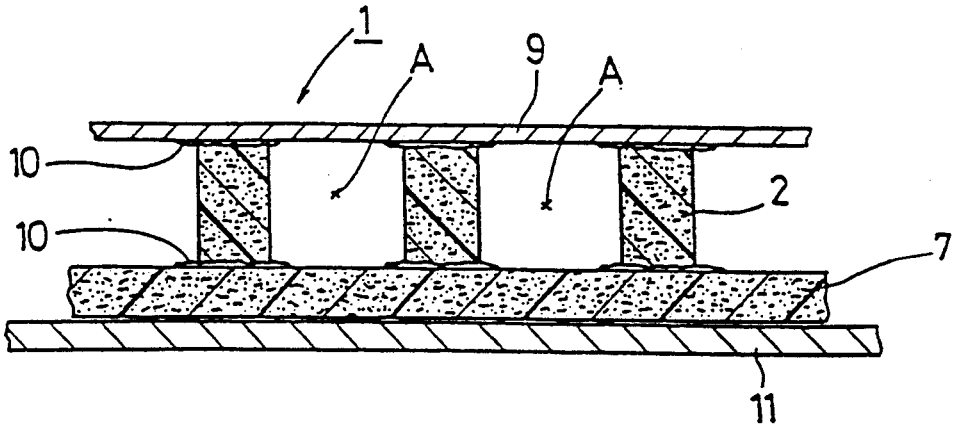
FIG. 1 shows a vertical cross-sectional view of the wave absorber according to a first embodiment of this invention
Figure 5:
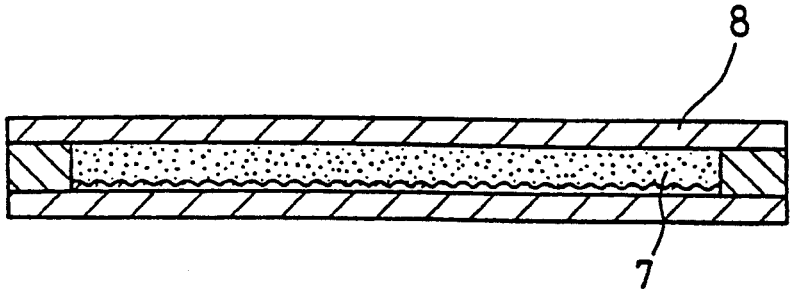
FIG. 5 illustrates molding of the electrically conductive filter plate.
Figure 6:
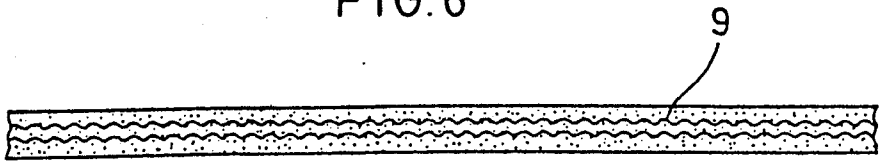
FIG. 6 shows a vertical cross-sectional view of the wave transmitting panel.

To the lattice-structured wave absorbing panel 2, an electrically conductive filter plate 7 constituting a conductive filter layer is attached as shown in FIG. 1. The electrically conductive filter plate 7 comprises a plate having an arbitrary thickness and an area of 1.0 $m^2$ and can be formed in the following manner. For example, a homogeneous mixture comprising 600 g of a ferrite powder ($Fe_3O_4$), 800 g of a brass fiber (as the metal fiber) having a diameter of 0.5 to 0.7 mm and a length of 10 to 15 mm a phenol resin is injected into a mold 8 as shown in FIG. 5 and allowed to be cured, and the cured product is released from the mold to obtain a rectangular electrically conductive filter plate 7.

The thus formed lattice-structured wave absorbing panel 2 and the electrically conductive filter plate 7 are bonded with an epoxy adhesive 10, as shown in FIG. 1, and the composite is fitted in a reinforcing metal frame 11 to complete a wave absorber 1. Incidentally, it is preferred that the wave absorber 1 has a wave transmitting plate 9 (thickness 0.5 to 1.0 mm) constituting the wave transmitting layer for protecting the wave absorber 1 from the outer air contaminated with exhaustion gases and the like as also bonded with an epoxy adhesive 10 on the surface thereof. Preferably used as the wave transmitting plate 9, for example, is one prepared by laminating a Kevlar cloth impregnated with an epoxy resin and a glass cloth impregnated with an epoxy resin, and after curing of the epoxy resins followed by coating of the surface of the laminate with an epoxy resin and a ceramic (Tio 23).

Figure 7:
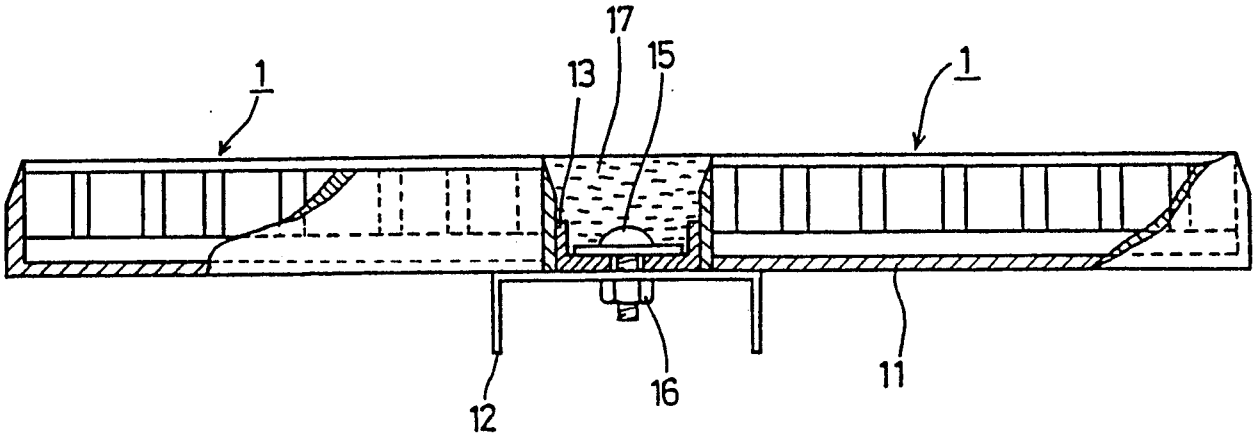
FIG. 7 shows a vertical cross-sectional view of the present wave absorber attached onto the wall surface of a building through a channel member.

The thus formed wave absorber 1 is installed, for example, as shown in FIG. 7. To describe in detail, rails 13 are applied on a multiplicity of channel members 12 exposed on the exterior wall surface of a large-scaled building, such as multi-storied buildings, with predetermined intervals, and the rails 13 are fixed on the channel members 12 by bolts 15 and nuts 16. The reinforcing metal frames 11 of the wave absorbers 1 are forcedly pressed into the spaces between the adjacent pairs of rails 13, whereby the wave absorbers 1 can be fixed on the exterior wall surface. It should be noted, however, that the edge of the metal frame 11 is chamfered along the perimeter thereof with a predetermined width to make the wave absorbing efficiency by the wave absorbers 1 as high as possible, and the joint between wave absorbers 1 is sealed with a compound 17 comprising a mixture of 50% of a silicone (JIS A 5755) and 50% of a ferrite powder ($Fe_3O_4$) to prevent reflection of waves and intrusion of rainwater as much as possible.

Figure 11:
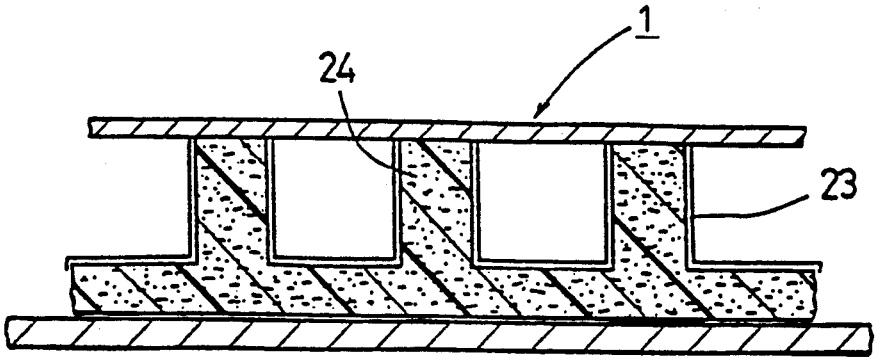
FIG. 11 shows a vertical cross-sectional view of a wave absorber according to still another embodiment of this invention.

Incidentally, the wave absorber 1 may be formed as an integrally molded product or an assembly, comprising a plastic frame 23 incorporated therein a wave absorbing panel 24, as shown in FIG. 11, whereby the wave absorber 1 can be used as the structural wall of a building or a member thereof having sufficient strength.

As has been described above, when a television wave such as of VHF or UHF region impinges upon the wave absorber attached to the exterior wall surface of a multistoried building or large-scaled warehouse, relatively high level of matching is achieved between the impedance as viewed from the wave emitting direction and that in the free space in the lattice-structured wave absorber 1 absorbs the television wave at high efficiency to assume substantially nonreflective posture, and the ghost phenomenon can thus be prevented effectively.

Figure 8:
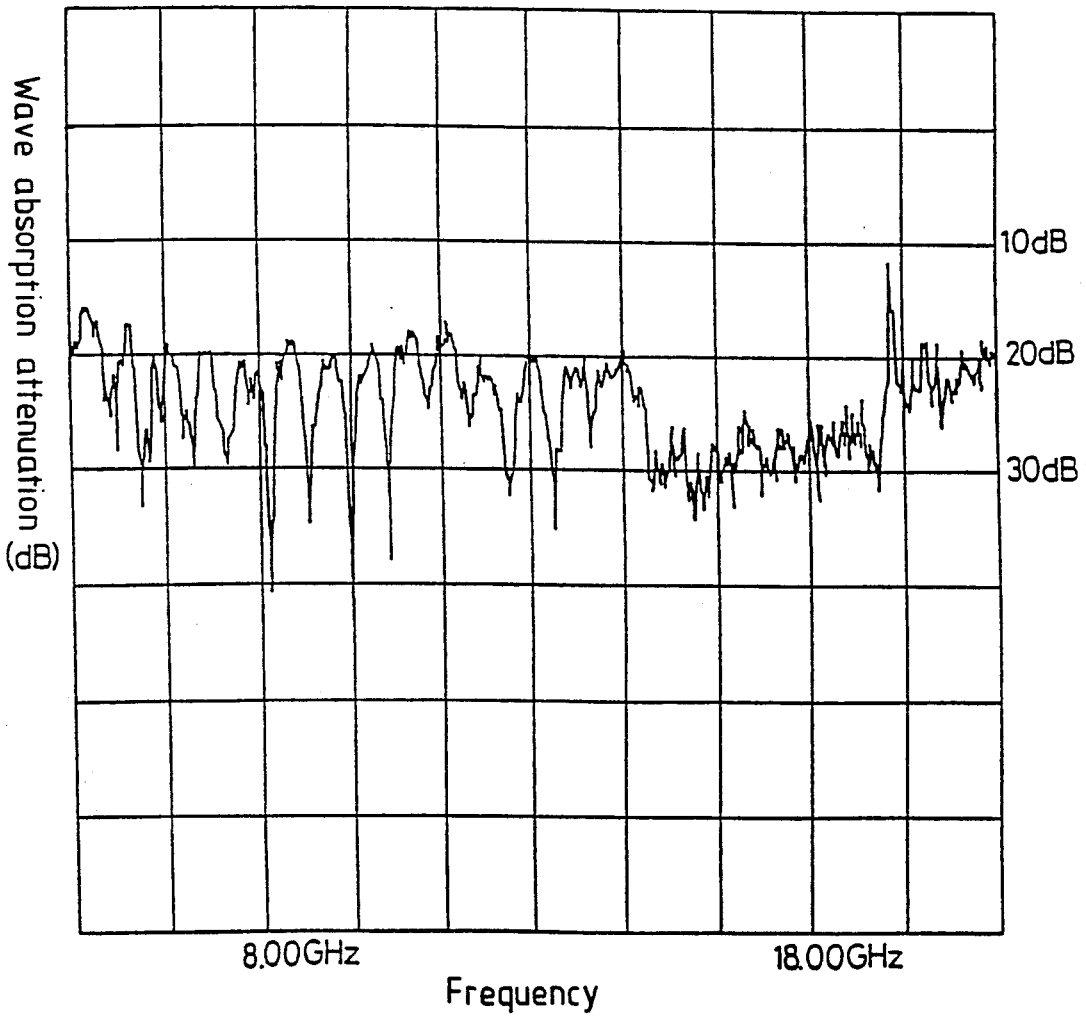
FIG. 8 shows a characteristic chart of the present wave absorber.

When wave absorption characteristics of the wave absorber 1 were determined by the testers manufactured by ADVANTEST CORPORATION (Spectrum Analyzer TR 4136, Synthesized Sweeper TR 4515, Sweep Adapter TR 13211 and X-Y Plotter TR 3835), it was found that a wave reflection attenuation of about 20 to 30 dB at a frequency of 8 to 18 GHz can be achieved as shown in FIG. 8. The test results show that the present wave absorber has sufficient wave absorption characteristics to be used as a wave absorber provided on the exterior wall surface of buildings for preventing ghost phenomenon or on the interior wall surface of anechoic chambers, or as the coating on the fuselage of military stealth aircraft which absorbs radar waves to disturb searching operations by the enemy.

What is claimed is:

1. A wave absorber comprising:

a wave absorbing panel made from a mixture containing a ferrite powder, a metal fiber, a molding material and a resin;

an arbitrary shape of hollow spaces formed in said wave absorbing panel which are adapted to the frequency and wave length of an electromagnetic wave to be absorbed; and an electrically conductive filter plate laminated on said panel.

2. The wave absorber according to claim 1, wherein the panel has a lattice structure.

3. The wave absorber according to claim 1, wherein the panel has a honeycomb structure.

4. The wave absorber according to claim 1, wherein the panel has an arbitrary shape of circular hollow spaces including ellipsoid.

5. The wave absorber according to claim 1 to 4, wherein the wave absorbing panel is molded in a mold.

6. The wave absorber according to claim 1 to 4, wherein the electrically conductive filter plate comprises a mixture of a ferrite powder, a metal fiber and a resin.

7. The wave absorber comprising:

a wave absorbing panel made from a mixture containing a ferrite powder, a metal fiber, a molding material and a resin;

a arbitrary shape of hollow spaces formed in said wave absorbing panel which are adapted to the frequency and wave length of an electromagnetic wave to be absorbed;

an electrically conductive filter plate laminated on said panel; and an electromagnetic wave transmitting plate having weathering resistance applied on the surface of the wave absorbing panel.

8. The wave absorber according to claim 7, wherein the electromagnetic wave transmitting plate is a reinforced ceramic panel comprising a ceramic plate with a Kevlar cloth, glass cloth or other web bonded thereto.

* * * * *